US009449607B2

(12) United States Patent
Rajendran et al.

(10) Patent No.: US 9,449,607 B2
(45) Date of Patent: Sep. 20, 2016

(54) SYSTEMS AND METHODS FOR DETECTING OVERFLOW

(71) Applicant: QUALCOMM Incorporated, San Diego, CA (US)

(72) Inventors: Vivek Rajendran, San Diego, CA (US); Ananthapadmanabhan Arasanipalai Kandhadai, San Diego, CA (US)

(73) Assignee: QUALCOMM Incorporated, San Diego, CA (US)

( * ) Notice: Subject to any disclaimer, the term of this patent is extended or adjusted under 35 U.S.C. 154(b) by 237 days.

(21) Appl. No.: 13/666,870

(22) Filed: Nov. 1, 2012

(65) Prior Publication Data

US 2013/0179159 A1 Jul. 11, 2013

Related U.S. Application Data

(60) Provisional application No. 61/584,109, filed on Jan. 6, 2012.

(51) Int. Cl.

| | |
|---|---|
| ***G10L 19/04*** | (2013.01) |
| ***G10L 19/083*** | (2013.01) |
| *G10L 19/005* | (2013.01) |

(52) U.S. Cl.

CPC ..... *G10L 19/083* (2013.01); *G10L 19/005* (2013.01)

(58) Field of Classification Search

CPC ..... G10L 19/005
USPC ..... 704/219
See application file for complete search history.

(56) References Cited

U.S. PATENT DOCUMENTS

| | | | | |
|---|---|---|---|---|
| 4,441,200 | A * | 4/1984 | Fette | G10L 19/06 704/207 |
| 5,893,060 | A * | 4/1999 | Honkanen | G10L 19/005 704/258 |
| 5,907,498 | A * | 5/1999 | Rim | 708/553 |
| 5,987,406 | A * | 11/1999 | Honkanen et al. | 704/220 |
| 6,006,179 | A * | 12/1999 | Wu et al. | 704/222 |
| 6,052,660 | A * | 4/2000 | Sano | 704/221 |
| 6,282,631 | B1 * | 8/2001 | Arbel | 712/35 |
| 6,424,940 | B1 | 7/2002 | Agassy et al. | |
| 6,539,355 | B1 * | 3/2003 | Omori et al. | 704/268 |
| 7,363,218 | B2 * | 4/2008 | Jabri et al. | 704/221 |
| 2004/0044524 | A1 * | 3/2004 | Minde et al. | 704/220 |

(Continued)

FOREIGN PATENT DOCUMENTS

| | | | |
|---|---|---|---|
| CN | 1272728 | A | 11/2000 |
| EP | 747884 | A2 * | 12/1996 |

OTHER PUBLICATIONS

ETSI "Digital cellular telecommunications system (Phase 2+); Enhanced Full Rate (EFR) speech transcoding (GSM 06.60 version 5.2.1)," ETS 300726, Jul. 1999, 2nd Edition <http://www.etsi.org/deliver/etsi_i_ets/300700_300799/300726/02_60/ets_300726e02p.pdf>.*

(Continued)

*Primary Examiner* — Oluwadamilola M Ogunbiyi
(74) *Attorney, Agent, or Firm* — Austin Rapp & Hardman

(57) ABSTRACT

A method for detecting overflow on an electronic device is described. The method includes determining a linear predictive coding synthesis filter gain. The method further includes determining whether overflow is detected based on the linear predictive coding synthesis filter gain and a fixed codebook gain. The method further includes determining a scaling factor if overflow is detected.

30 Claims, 10 Drawing Sheets

(56) References Cited

U.S. PATENT DOCUMENTS

| | | | | |
|---|---|---|---|---|
| 2007/0076827 | A1 | 4/2007 | Beamish et al. | |
| 2009/0204412 | A1 | 8/2009 | Kovesi et al. | |
| 2009/0247105 | A1 | 10/2009 | Mak | |
| 2010/0057447 | A1* | 3/2010 | Ehara | 704/219 |
| 2010/0135437 | A1 | 6/2010 | Lee et al. | |

OTHER PUBLICATIONS

International Search Report and Written Opinion—PCT/US2012/071196—ISA/EPO—Apr. 3, 2013.

3GPP2 C.S0014-E, Version 1.0: Enhanced Variable Rate Codec, Speech Service Options 3, 68, 70, 73 and 77 for Wideband Spread Spectrum Digital Systems, Dec. 2011: http://www.3gpp2.org/Public_html/specs/C.S0014-E_v1.0_EVRC_20111231.pdf.

ETSI TS 126 090, "Digital cellular telecommunications system (Phase 2+); Universal Mobile Telecommunications System (UMTS); LTE; Mandatory Speech Codec speech processing functions; Adaptive Multi-Rate (AMR) speech codec; Transcoding functions," 3GPP TS 26.090 version 11.0.0 Release 11, Oct. 2012, pp. 57.

* cited by examiner

SYSTEMS AND METHODS FOR DETECTING OVERFLOW

RELATED APPLICATIONS

This application is related to and claims priority from U.S. Provisional Patent Application Ser. No. 61/584,109 filed Jan. 6, 2012, for "DEVICES FOR DETECTING SATURATION."

TECHNICAL FIELD

The present disclosure relates generally to signal processing. More specifically, the present disclosure relates to systems and methods for detecting overflow.

BACKGROUND

In the last several decades, the use of electronic devices has become common. In particular, advances in electronic technology have reduced the cost of increasingly complex and useful electronic devices. Cost reduction and consumer demand have proliferated the use of electronic devices such that they are practically ubiquitous in modern society. As the use of electronic devices has expanded, so has the demand for new and improved features of electronic devices. More specifically, electronic devices that perform functions faster, more efficiently or with higher quality are often sought after.

Some electronic devices (e.g., cellular phones, smart phones, computers, etc.) use audio or speech signals. These electronic devices may code speech signals for storage or transmission. For example, a cellular phone captures a user's voice or speech using a microphone. The microphone converts an acoustic signal into an electronic signal. This electronic signal may then be formatted (e.g., coded) for transmission to another device (e.g., cellular phone, smart phone, computer, etc.), for playback or for storage.

Sending an uncompressed speech signal may be costly in terms of bandwidth and/or storage resources, for example. Some schemes exist that attempt to represent a speech signal more efficiently (e.g., using less data). However, these schemes may not represent some parts of a speech signal well, resulting in degraded performance. As can be understood from the foregoing discussion, systems and methods that improve signal coding may be beneficial.

SUMMARY

A method for detecting overflow on an electronic device is described. The method includes determining a linear predictive coding synthesis filter gain. The method also includes determining whether overflow is detected based on the linear predictive coding synthesis filter gain and a fixed codebook gain. The method further includes determining a scaling factor if overflow is detected. Determining the linear predictive coding synthesis filter gain may include determining an impulse response corresponding to a linear predictive coding synthesis filter and determining an energy of the impulse response. The electronic device may be a wireless communication device. The scaling factor may be determined such that an output of a linear predictive coding synthesis filter does not exceed a maximum dynamic range.

The method may include scaling a signal based on the scaling factor if overflow is detected. The method may be performed by a decoder and/or an encoder.

Overflow may be detected if the linear predictive coding synthesis filter gain is greater than or equal to a synthesis filter gain threshold and if the fixed codebook gain is greater than or equal to a fixed codebook gain threshold. Determining whether overflow is detected may be further based on an adaptive codebook gain. Overflow may be detected if the linear predictive coding synthesis filter gain is greater than or equal to a synthesis filter gain threshold, if the fixed codebook gain is greater than or equal to a fixed codebook gain threshold and if an adaptive codebook gain is greater than or equal to an adaptive codebook gain threshold.

Determining whether overflow is detected may include determining whether a synthesis filter output would exceed a maximum allotted dynamic range if a synthesis filter input is not scaled down. If overflow is detected, the scaling factor may not be applied to a signal that is carried forward to a subsequent frame or subframe.

An electronic device for detecting overflow is also described. The electronic device includes synthesis filter gain determination circuitry that determines a linear predictive coding synthesis filter gain. The electronic device also includes an overflow detector coupled to the synthesis filter gain determination circuitry. The overflow detector determines whether overflow is detected based on the linear predictive coding synthesis filter gain and a fixed codebook gain. The electronic device further includes scaling factor determination circuitry coupled to the overflow detector. The scaling factor determination circuitry determines a scaling factor if overflow is detected.

A computer-program product for detecting overflow is also described. The computer-program product includes a non-transitory tangible computer-readable medium with instructions. The instructions include code for causing an electronic device to determine a linear predictive coding synthesis filter gain. The instructions also include code for causing the electronic device to determine whether overflow is detected based on the linear predictive coding synthesis filter gain and a fixed codebook gain. The instructions further include code for causing the electronic device to determine a scaling factor if overflow is detected.

An apparatus for detecting overflow is also described. The apparatus includes means for determining a linear predictive coding synthesis filter gain. The apparatus also includes means for determining whether overflow is detected based on the linear predictive coding synthesis filter gain and a fixed codebook gain. The apparatus further includes means for determining a scaling factor if overflow is detected.

DETAILED DESCRIPTION

Figure 1:
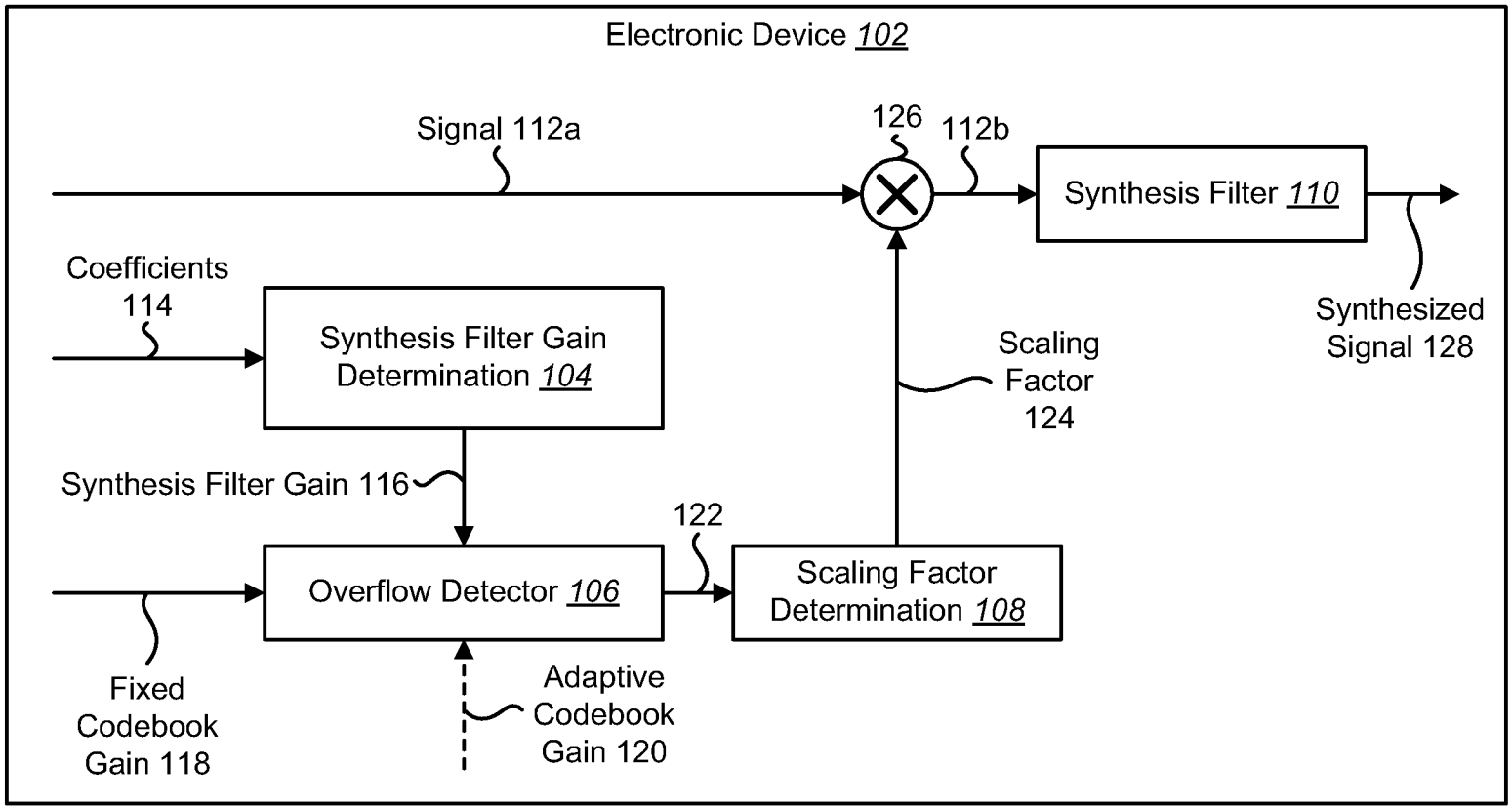
FIG. 1 is a block diagram illustrating one configuration of an electronic device in which systems and methods for detecting overflow may be implemented.

The systems and methods disclosed herein may be applied to a variety of electronic devices. Examples of electronic devices include cellular phones, smartphones, voice recorders, video cameras, audio players (e.g., Moving Picture Experts Group-1 (MPEG-1) or MPEG-2 Audio Layer 3 (MP3) players), video players, audio recorders, desktop computers, laptop computers, personal digital assistants (PDAs), gaming systems, etc. One kind of electronic device is a communication device, which may communicate with another device. Examples of communication devices include telephones, laptop computers, desktop computers, cellular phones, smartphones, wireless or wired modems, e-readers, tablet devices, gaming systems, cellular telephone base stations or nodes, access points, wireless gateways and wireless routers.

An electronic device (e.g., communication device) may operate in accordance with certain industry standards, such as International Telecommunication Union (ITU) standards and/or Institute of Electrical and Electronics Engineers (IEEE) standards (e.g., Wireless Fidelity or "Wi-Fi" standards such as 802.11a, 802.11b, 802.11g, 802.11n and/or 802.11ac). Other examples of standards that a communication device may comply with include IEEE 802.16 (e.g., Worldwide Interoperability for Microwave Access or "WiMAX"), 3rd Generation Partnership Project (3GPP), 3GPP Long Term Evolution (LTE), 3rd Generation Partnership Project 2 (3GPP2), Global System for Mobile Telecommunications (GSM) and others (where a communication device may be referred to as a User Equipment (UE), NodeB, evolved NodeB (eNB), mobile device, mobile station, subscriber station, remote station, access terminal, mobile terminal, terminal, user terminal, subscriber unit, etc., for example). While some of the systems and methods disclosed herein may be described in terms of one or more standards, this should not limit the scope of the disclosure, as the systems and methods may be applicable to many systems and/or standards.

It should be noted that some communication devices may communicate via a wireless communication link and/or a wired communication link. For example, some communication devices may communicate with other devices via radio frequency (RF) signals, optical signals (e.g., laser link, fiber optic link), infrared (IR) signals and/or electronic signals on a wire. The systems and methods disclosed herein may be applied to communication devices that communicate via a wireless link and/or that communicate via a wired link. In some configurations, the systems and methods disclosed herein may be applied to a communication device that communicates with another device using a satellite.

The systems and methods disclosed herein describe devices for detecting overflow. For example, the systems and methods disclosed herein describe an overflow detector and adaptive gain scaling to prevent overflow for linear predictive coding (LPC) based speech coders. In particular, saturation may result from overflow. The systems and methods disclosed herein may detect overflow of an output (that may exceed a maximum allowed dynamic range if an input is not scaled down, for example).

Linear predictive coding (LPC) coders may have instability issues. For example, instability may cause audio blow-ups, especially for steady tonal/resonant signals in the presence of frame errors. Frame errors cause a mismatch between the encoder and decoder. This mismatch can cause instability, especially for a steady tonal/highly resonant signal. For instance, this error can cause overflows in an all-pole linear predictive coding synthesis filter, which may lead to instability and cause audio blow ups. This phenomenon gets exaggerated for finite precision (e.g., fixed point) implementations, since there is an increased probability of saturated linear predictive coding synthesis filter states (e.g., memories), thereby causing instability.

Some configurations of the systems and methods disclosed herein provide an open-loop mechanism that monitors fixed codebook (FCB) gain and/or adaptive codebook (ACB) gain corresponding to a residual signal or excitation signal before an linear predictive coding synthesis filter and adaptively scales down the residual signal or excitation signal input into the synthesis filter to ensure that the output of the linear predictive coding synthesis filter does not exceed a maximum allowed dynamic range (e.g., 16 bits signed). However, it should be noted that this may not scale the residual signal or excitation signal pitch memory feeding into the next (e.g., subsequent) frame, since that may severely impact tonal quality).

Some examples are given below for an input signal (into a coder, for example) and for an output signal (from a decoder, for example) with a dynamic range of 16 bits (signed). However, it should be noted that the systems and methods disclosed herein do not necessarily depend on these values and they are merely examples. For instance, 16 bits signed is commonly used in speech coders, but the systems and methods disclosed herein may be applied to other implementations that do not use 16 bits signed.

In accordance with the systems and methods disclosed herein, an electronic device may determine (e.g., compute) the linear predictive coding synthesis filter gain. An adaptive scale factor for the speech frame or subframe to be synthesized may be determined if overflow is detected. Overflow may be detected if any of the following conditions occur. For example, overflow may be detected if the linear predictive coding synthesis filter gain reaches a synthesis filter gain threshold (e.g., >18 decibels (dB)) and the corresponding fixed codebook gain reaches a fixed codebook gain threshold (e.g., ≥2322). As used herein, the term "reach" and variations thereof may be used to mean "meets and/or exceeds" or "is greater than and/or is equal to."

When overflow occurs, for example, the synthesized speech output may exceed a maximum (e.g., 16 bit signed arithmetic) dynamic range. In some implementations, for instance, 18 dB of linear predictive coding gain corresponds to three bits (e.g., one bit corresponds to 6 dB) and 12 bits are required to represent a value of 2322. This may result in the output requiring 3+12=15 bits of dynamic range, which is the maximum dynamic range for a signed 16-bit number. Since the original speech signal inputted into the encoder may be limited to a maximum (e.g., 16 bits) dynamic range in some implementations, the occurrence of the above condition at the decoder may be a good indication of encoder-decoder mismatch for analysis-by-synthesis code excited linear prediction (CELP) coders.

In some configurations, overflow may be detected if the linear predictive coding synthesis filter gain reaches a synthesis filter gain threshold, if the corresponding fixed codebook gain reaches a fixed codebook gain threshold and a corresponding adaptive codebook gain reaches an adaptive codebook gain threshold (e.g., ≥1.0). For example, an adaptive codebook gain that reaches a certain threshold may also be an indication of a critically stable or unstable system.

If overflow is detected, then a scaling factor for the speech subframe or frame under question may be determined such that the output of the linear predictive coding synthesis filter does not exceed the maximum allowed dynamic range (e.g., 16-bit signed). Additionally or alternatively, one or more bits of headroom may also be allowed. For example, the scaling factor may be determined such that the final output of the linear predictive coding synthesis filter does not exceed the maximum allowed dynamic range of 15-bit signed (allowing for a 1 bit for headroom, for instance).

The scaling factor may be determined as described above on a per-frame or per-subframe basis. For example, the scaling factor may be determined any time a linear predictive coding synthesis filter is used to generate the decoded speech output. This could be on a subframe or frame basis and then applied to the input of the linear predictive coding synthesis filter.

Since the inter-frame/subframe predictive component may be very high for tonal/steady state signals, the scaling factor may not be applied to the signal (e.g., residual signal or excitation signal) that is carried forward into the next frame/subframe since it may severely impact tonal quality.

The systems and methods disclosed herein may have some advantages and differentiating aspects over known approaches. For example, the adaptive multi-rate (AMR) speech codec solves this problem using a closed loop mechanism that checks for saturation in the linear predictive coding synthesis filter. If saturation is detected, then the input is scaled down by a fixed factor of 4 (e.g., 2 bits) and the linear predictive coding synthesis is redone. However, the systems and methods disclosed herein may be open-loop and hence, less computationally intensive. Furthermore, the systems and methods disclosed herein may provide adaptive scaling to ensure that an improved (e.g., optimal) scaling factor is used instead of a fixed/sub-optimal scaling factor.

Also, the systems and methods disclosed herein differ from known closed loop automatic gain control (AGC), since they use speech coding parameters (e.g., linear predictive coding synthesis filter gain, fixed codebook gain and/or adaptive codebook gain) to trigger application of an adaptive scale factor to the input of a synthesis filter in an open-loop fashion (e.g., before the generation of corresponding output samples). For example, the systems and methods may not perform known AGC techniques where a first pass is performed to determine an output level and the output level is fed back to into the input. For instance, the systems and methods disclosed herein may instead detect overflow and scale an input in an open-loop/single-pass fashion.

Furthermore, the systems and methods disclosed herein may differ from other known techniques in that they may focus on a linear predictive coding synthesis filter (e.g., excitation-to-speech filtering) and not necessarily on a long-term prediction (LTP) filter. For instance, the systems and methods disclosed herein may scale down (with a factor less than 1, for example) a synthesis filter input. Determining whether to scale down the input (e.g., whether overflow is detected) may be based on synthesis filter gain and fixed codebook gain.

It should be noted that two or more of the elements described herein may be coupled together. As used herein, the term "couple" and variations thereof may mean that two or more elements may be connected directly or indirectly (e.g., through another element). For example, a first element that is coupled to a second element may be directly connected to the second element (by a wire or bus, for instance) or may be indirectly connected to the second element through a third element. Couplings may be depicted as lines or arrows in the Figures. However, it should be noted that, in some cases, not all possible couplings may be depicted for simplicity, clarity and convenience.

Various configurations are now described with reference to the Figures, where like reference numbers may indicate functionally similar elements. The systems and methods as generally described and illustrated in the Figures herein could be arranged and designed in a wide variety of different configurations. Thus, the following more detailed description of several configurations, as represented in the Figures, is not intended to limit scope, as claimed, but is merely representative of the systems and methods.

FIG. 1 is a block diagram illustrating one configuration of an electronic device 102 in which systems and methods for detecting overflow may be implemented. The electronic device 102 includes a (linear predictive coding) synthesis filter gain determination block/module 104, an overflow detector 106, a scaling factor determination block/module 108, a multiplier 126 (e.g., amplifier, attenuator, etc.) and a (linear predictive coding) synthesis filter 110. As used herein, the term "block/module" indicates that an element may be implemented in hardware (e.g., circuitry), software or a combination of both. For example, the scaling factor determination block/module 108 may be implemented in hardware, software or a combination of both. Moreover, it should be noted that one or more of the elements depicted within the electronic device 102 may be implemented as circuitry.

The synthesis filter gain determination block/module 104 may determine a (linear predictive coding) synthesis filter gain 116. For example, the synthesis filter gain determination block/module 104 may determine the synthesis filter gain 116 based on (linear predictive coding) coefficients 114. The synthesis filter gain 116 and a fixed codebook gain 118 may be provided to the overflow detector 106. In some configurations, an adaptive codebook gain 120 may also be provided to the overflow detector 106.

The overflow detector 106 may determine whether or not overflow (e.g., prospective overflow and/or saturation) is detected. For example, the overflow detector 106 may determine whether or not overflow (and/or saturation, for example) would occur at the output of the synthesis filter 110 if the input is not scaled down. For instance, determining whether overflow (e.g., prospective overflow) is detected may include determining whether the synthesis filter 110 output would exceed a maximum allotted dynamic range (e.g., 16 bits) if the synthesis filter 110 input is not scaled down. If the input were not scaled down in that case, for example, the output might be capped to a maximum value. In one configuration, determining whether overflow is detected may be made based on the synthesis filter gain 116 and the fixed codebook gain 118. For example, the overflow detector 106 may determine whether the synthesis filter gain 116 reaches a synthesis filter gain threshold (e.g., ≥18 dB) and may determine whether the fixed codebook gain 118 reaches a fixed codebook threshold (e.g., ≥2322).

For instance, the synthesis filter gain 116 may require a number of bits for representation and the fixed codebook gain 118 may require another number of bits for representation. If the total number of bits required to represent the synthesis filter gain 116 and the fixed codebook gain 118 exceed (e.g., meet or exceed in some configurations) the number of bits available for a maximum dynamic range at the output of the synthesis filter 110 (or another threshold amount), then overflow may be detected.

In one example, 18 dB of synthesis filter gain 116 corresponds to three bits (e.g., one bit corresponds to 6 dB) and 12 bits are required to represent a value of 2322 for the fixed codebook gain 118. This may result in the output requiring 3+12=15 bits of dynamic range, which is the maximum dynamic range for a signed 16-bit number.

In some configurations, overflow detection may additionally be based on the adaptive codebook gain 120. For example, if the synthesis filter gain 116 reaches a synthesis filter gain threshold, if the corresponding fixed codebook gain 118 reaches a fixed codebook gain threshold and the corresponding adaptive codebook gain 120 reaches an adaptive codebook gain threshold (e.g., ≥1.0), then the overflow detector 106 may detect overflow.

In the case that overflow is detected, the overflow detector 106 may provide an indication 122 to the scaling factor determination block/module 108. In this case, the scaling factor determination block/module 108 may determine a scaling factor 124. For example, the scaling factor 124 may be determined such that the output of the synthesis filter 110 (e.g., the synthesized signal 128) does not exceed the maximum allowed dynamic range. Additionally or alternatively, the scaling factor 124 may be determined such that the output of the linear predictive synthesis filter allows an amount of headroom (e.g., 1 bit).

As illustrated in FIG. 1, a signal 112*a* (e.g., residual signal or excitation signal) may be scaled based on the scaling factor 124. For example, the signal 112*a* may be scaled by the multiplier 126 in accordance with the scaling factor 124 before being input into the synthesis filter 110. For instance, if overflow is detected, then the signal 112*a* may be scaled down. If no overflow is detected, then the signal 112*a* may not be scaled (or may be scaled by a factor of 1). The resulting signal 112*b* (e.g., a product of the signal 112*a* and the scaling factor 124 when overflow is detected or a non-scaled (or scaled by 1) signal when overflow is not detected) may be provided to the synthesis filter 110. Accordingly, scaling down the signal 112*a* may prevent actual overflow from occurring when overflow (e.g., prospective overflow) is detected. It should be noted that a residual signal or excitation signal that is carried forward to a subsequent frame may not be scaled (since this could impact tonal quality, for example).

The synthesis filter 110 may produce a synthesized signal 128 based on the signal 112. The synthesized signal 128 may be a synthesized speech signal, for example. For instance, the synthesized signal 128 may be provided to one or more speakers for output, may be provided to a transmitter for transmission and/or may be provided to memory for storage.

It should be noted that the elements illustrated in FIG. 1 (e.g., synthesis filter gain determination block/module 104, overflow detector 106, scaling factor determination block/module 108, multiplier 126 and synthesis filter 110) may be included in an encoder, a decoder or both. For example, the elements may be included in a decoder, where the electronic device 102 receives and decodes a coded signal to yield an audio signal (e.g., synthesized speech signal). Additionally or alternatively, the elements may be included in an encoder in order to prevent overflow.

Figure 2:
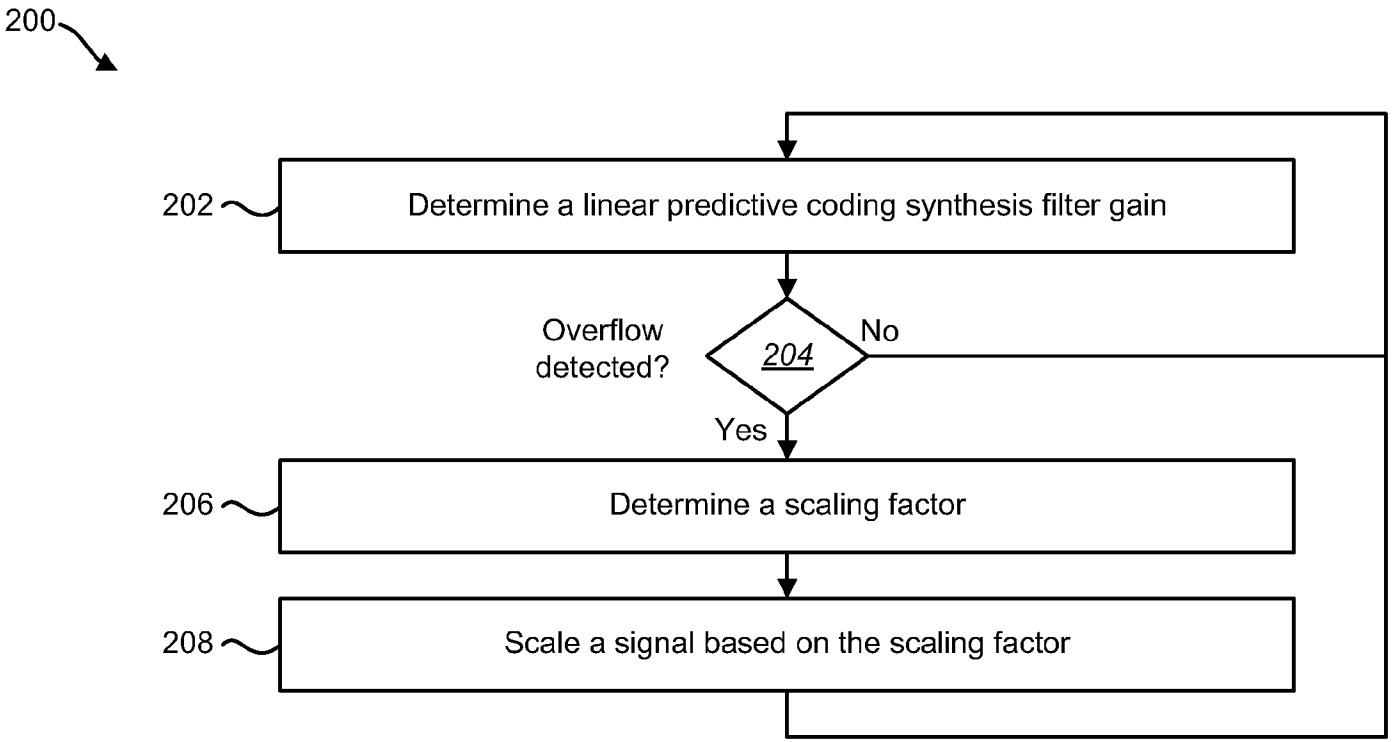
FIG. 2 is a flow diagram illustrating one configuration of a method for detecting overflow.

FIG. 2 is a flow diagram illustrating one configuration of a method 200 for detecting overflow. An electronic device 102 may determine 202 a (linear predictive coding) synthesis filter gain 116. For example, the electronic device 102 may determine an impulse response (e.g., h(i), where i=0 . . . N) corresponding to the synthesis filter 110. For example, an impulse signal may be used to excite a filter specified by the (linear predictive coding) coefficients 114 (e.g., the synthesis filter 110 or an equivalent filter), thereby yielding an impulse response. The electronic device 102 may determine the energy (e.g., the sum of the squared values of the impulse response) of the impulse response to yield a linear gain. In some configurations, this linear gain may be converted to the log domain (e.g., $10*\log_{10}$(linear gain)).

The electronic device 102 may determine 204 whether overflow (e.g., prospective overflow) is detected. For instance, determining 204 whether overflow (e.g., prospective overflow) is detected may include determining whether the synthesis filter 110 output would exceed a maximum allotted dynamic range (e.g., 16 bits) if the synthesis filter 110 input is not scaled down. If the input were not scaled down in that case, for example, the output might be capped to a maximum value. In some configurations, this determination 204 may be based on the synthesis filter gain 116 and the fixed codebook gain 118. For example, if the synthesis filter gain 116 reaches a synthesis filter gain threshold and the fixed codebook gain 118 reaches a fixed codebook gain 118 threshold, the electronic device 102 may detect overflow. Otherwise, overflow may not be detected. One example of how a fixed codebook gain 118 may be determined may be found in 3GPP2 C.S0014-B, version 1.0, section 4.9.8.6. However, other approaches may be used.

In other configurations, this determination 204 may be additionally based on an adaptive codebook gain 120. For example, if the synthesis filter gain 116 reaches a synthesis filter gain threshold, the fixed codebook gain 118 reaches a fixed codebook gain threshold and adaptive codebook gain 120 reaches an adaptive codebook gain threshold, the electronic device 102 may detect overflow. Otherwise, overflow may not be detected. One example of how a pitch or adaptive codebook gain may be determined may be found in 3GPP2 C.S0014-B, version 1.0, section 4.9.4.9. However, other approaches may be used. It should be noted that some approaches for determining adaptive codebook (ACB) or pitch and fixed codebook (FCB) or innovation gain are known in conjunction with CELP-based speech coders. Furthermore, different types of fixed codebooks exist. However, it should be noted that the systems and methods disclosed herein are not limited to a particular type of fixed codebook.

If overflow is not detected, the electronic device 102 may return to determine 202 a synthesis filter gain 116. This may be done for a subsequent frame or subframe. It should be noted that in the case that overflow is not detected, the electronic device 102 may not scale the signal 112*a* or may scale the signal 112*a* by a factor of 1, for example.

If overflow is detected, the electronic device 102 may determine 206 a scaling factor 124. For example, the scaling factor 124 may be determined 206 such that the output of the synthesis filter 110 (e.g., the synthesized speech) does not exceed a maximum allowed dynamic range. Additionally or alternatively, the scaling factor 124 may be determined such that the output of the linear predictive synthesis filter allows an amount of headroom (e.g., 1 bit).

In some configurations, determining 204 whether overflow is detected and determining 206 the scaling factor may proceed as illustrated in Listing (1) below. Let lpc_gain denote the (linear predictive coding) synthesis filter gain and lpc_gain_bits denote the corresponding number of bits (where 1 bit=6 dB of gain, for example). Also, let FCB_gain denote the fixed codebook gain and FCB_gain_bits denote the corresponding number of bits needed to represent the fixed codebook gain. Furthermore, let Scale_Factor denote the scaling factor 124, output_bits denote a number of output bits (at the output of the synthesis filter 110, for example) and headroom_bits denote a number a bits allowed for headroom. Listing (1) illustrates one example of pseudocode for determining 204 whether overflow is detected and determining 206 the scaling factor 124.

Listing (1)

```
if((FCB_gain ≥ 2322) && (lpc_gain > 18 dB))
    {
        Scale_Factor = lpc_gain_bits + FCB_gain_bits –
output_bits – headroom_bits;
    }
```

It should be noted that the threshold values (e.g., 2322 and 18 dB) illustrated in Listing (1) are examples. Other threshold values may be used. In one example, output_bits=15 and headroom_bits=1.

The electronic device 102 may scale 208 a signal 112 based on the scaling factor 124. For example, a residual signal or excitation signal 112 may be multiplied by the scaling factor 124 before being input into the synthesis filter 110. For instance, if overflow is detected, then the signal 112 may be scaled down. The signal 112 (e.g., scaled signal) may be provided to a synthesis filter 110, which may produce a synthesized signal 128 (e.g., synthesized speech signal) based on the signal 112. It should be noted that a signal 112*a* (e.g., a residual signal or excitation signal) that is carried forward to a subsequent frame may not be scaled. The electronic device 102 may return to determine 202 a synthesis filter gain 116. This may be done for a subsequent frame or subframe.

Figure 3:
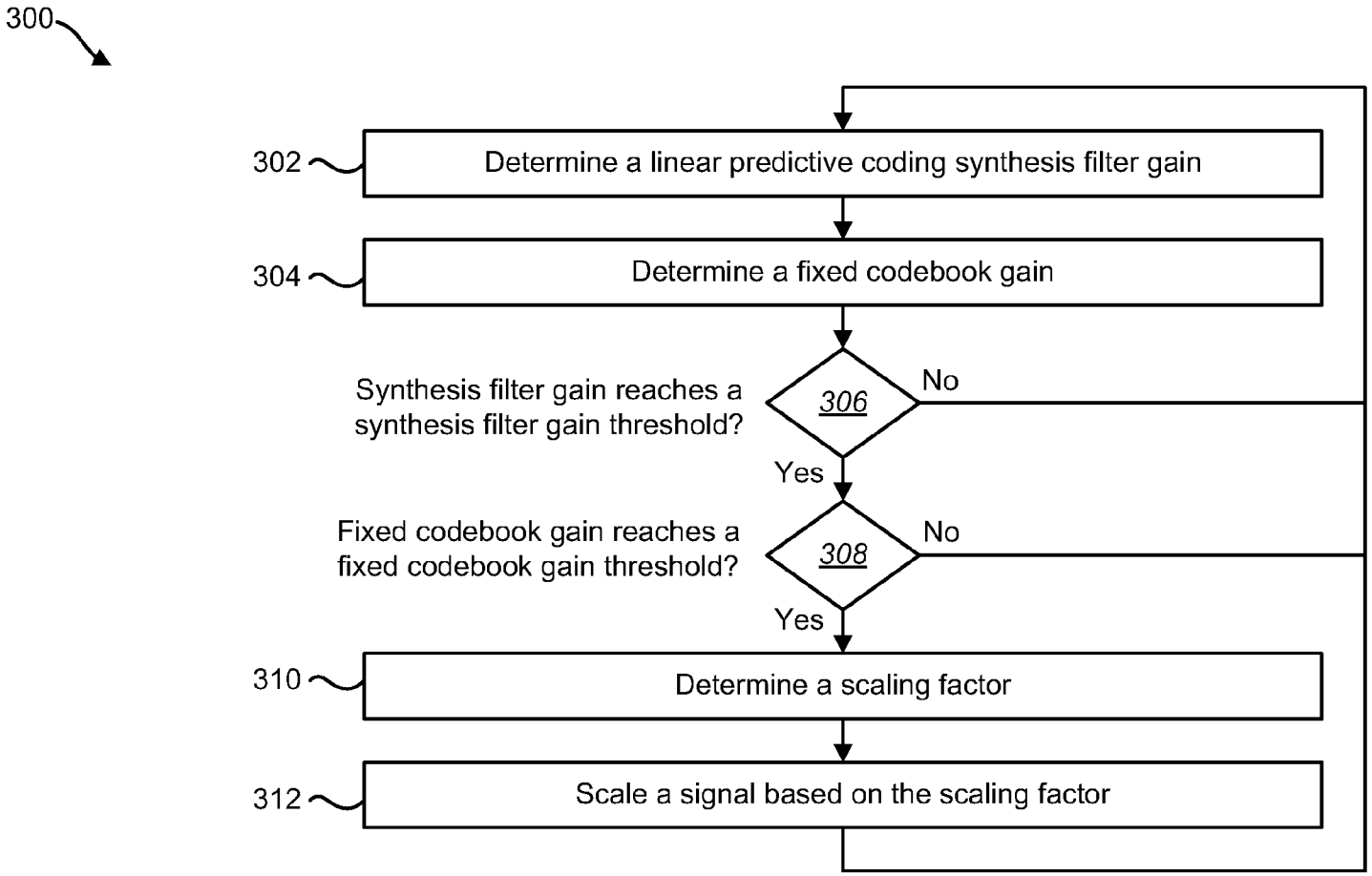
FIG. 3 is a flow diagram illustrating a more specific configuration of a method for detecting overflow.

FIG. 3 is a flow diagram illustrating a more specific configuration of a method 300 for detecting overflow. An electronic device 102 may determine 302 a (linear predictive coding) synthesis filter gain 116. This may be accomplished as described above in connection with FIG. 2, for example.

The electronic device 102 may determine 304 a fixed codebook gain 118. In some configurations, the electronic device 102 may determine 304 the fixed codebook gain 118 by receiving the fixed codebook gain 118 (from an encoder on a different electronic device or on the same electronic device 102, for example). Alternatively, the electronic device 102 may calculate the fixed codebook gain 118. For example, the fixed codebook gain 118 may be determined 304 based on a fixed codebook vector, a synthesis filter impulse response and a perceptual domain target signal. For instance, the fixed codebook gain 118 may be determined 304 in accordance with the equation $$g_c = \frac{d^t c_k}{c_k^t \Phi c_k},$$

where $g_c$ is the fixed codebook gain 118, $c_k$ is an algebraic codebook vector at an index k, d is a cross-correlation between the perceptual domain target signal and the synthesis filter impulse response, Φ is a correlation matrix of the synthesis filter impulse response and t denotes transpose. For instance, this may be accomplished as described in 3GPP2 C.S0014-B, version 1.0, section 4.9.8.6. It should be noted, however, that other approaches may be used.

The electronic device 102 may determine 306 whether the synthesis filter gain 116 reaches a synthesis filter gain threshold (e.g., ≥18 dB). In one example, 18 dB of synthesis filter gain 116 corresponds to three bits (e.g., one bit corresponds to 6 dB). If the synthesis filter gain 116 does not reach (e.g., is less than) the synthesis filter gain threshold (e.g., 18 dB), then the electronic device 102 may return to determine 302 a linear predictive coding synthesis filter gain (for a subsequent frame or subframe, for example).

If the synthesis filter gain 116 reaches (e.g., is greater than or equal to) the synthesis filter gain threshold (e.g., 18 dB), then the electronic device 102 may determine 308 whether the fixed codebook gain 118 reaches a fixed codebook gain threshold (e.g., ≥2322). In one example, 12 bits are required to represent a value of 2322 for the fixed codebook gain 118. If the fixed codebook gain 118 does not reach (e.g., is less than) the fixed codebook gain threshold (e.g., 2322), then the electronic device 102 may return to determine 302 a linear predictive coding synthesis filter gain (for a subsequent frame or subframe, for example). If the fixed codebook gain 118 reaches the fixed codebook gain threshold (e.g., 2322), for example, this may result in the output requiring at least a maximum dynamic range (e.g., 3+12=15 bits of dynamic range, which is the maximum dynamic range for a signed 16-bit number) potentially causing overflow.

If the fixed codebook gain 118 reaches (e.g., is greater than or equal to) the fixed codebook gain threshold (e.g., 2322), then the electronic device 102 may determine 310 a scaling factor. For example, the scaling factor 124 may be determined 310 such that the output of the synthesis filter 110 (e.g., the synthesized speech) does not exceed a maximum allowed dynamic range. Additionally or alternatively, the scaling factor 124 may be determined such that the output of the linear predictive synthesis filter allows an amount of headroom (e.g., 1 bit). This may be accomplished as described in connection with FIG. 2.

The electronic device 102 may scale 312 a signal 112 based on the scaling factor 124. For example, this may be done as described above in connection with FIG. 2. The electronic device 102 may return to determine 302 a synthesis filter gain 116. This may be done for a subsequent frame or subframe.

Figure 4:
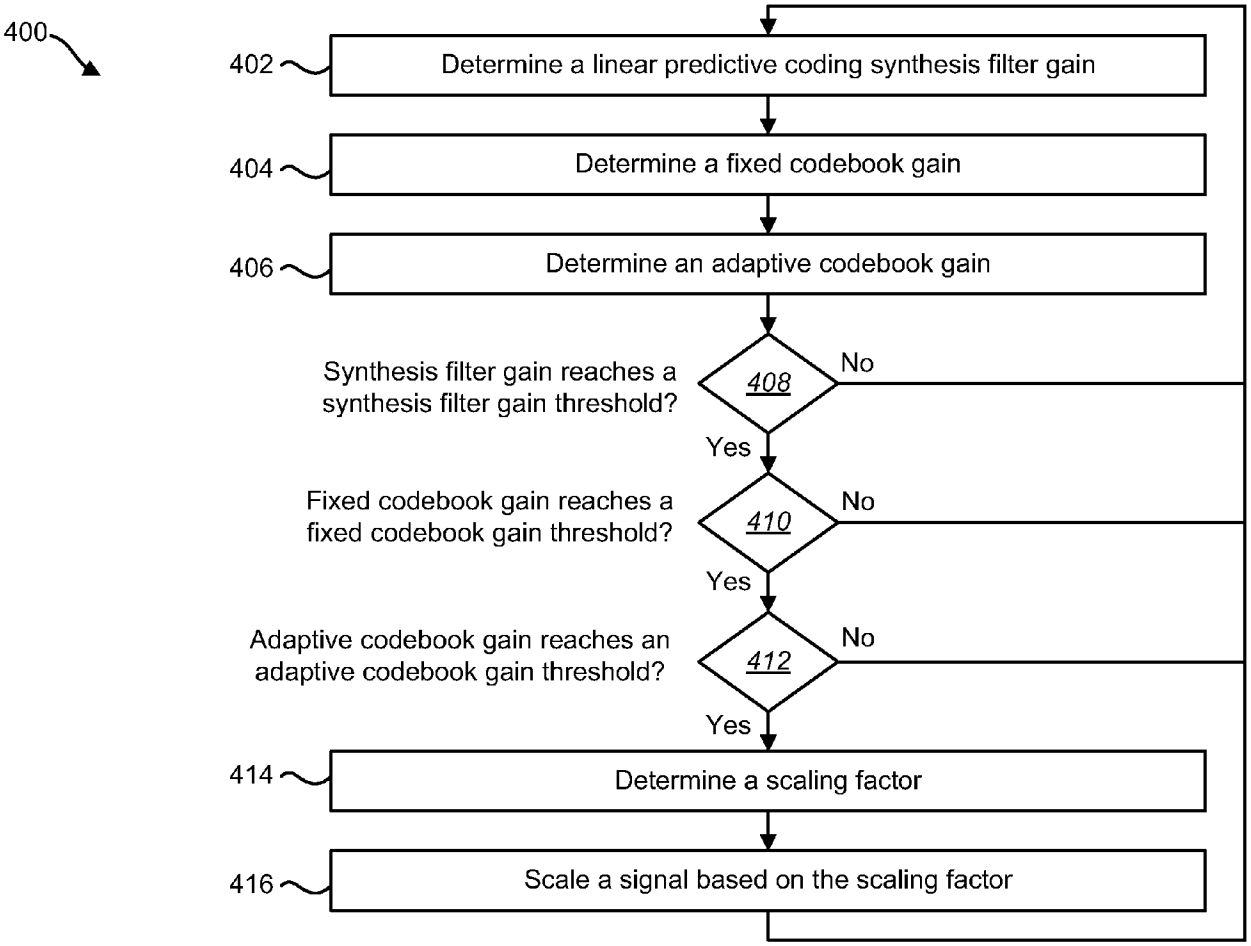
FIG. 4 is a flow diagram illustrating another more specific configuration of a method for detecting overflow.

FIG. 4 is a flow diagram illustrating another more specific configuration of a method 400 for detecting overflow. An electronic device 102 may determine 402 a (linear predictive coding) synthesis filter gain 116. This may be accomplished as described above in connection with FIG. 2, for example.

The electronic device may determine 404 a fixed codebook gain 118. For example, the fixed codebook gain 118 may be determined as described above in connection with FIG. 3.

The electronic device 102 may determine 406 an adaptive codebook gain 120. In some configurations, the electronic device 102 may determine 304 the adaptive codebook gain 120 by receiving the adaptive codebook gain 120 (from an encoder, for example). Alternatively, the electronic device 102 may calculate the adaptive codebook gain 120. For example, the adaptive codebook gain 120 may be determined 406 based on a synthesized signal (e.g., a weighted original speech vector), an adaptive codebook excitation and a synthesis filter impulse response. For instance, a pitch or adaptive codebook gain 120 may be determined as described in 3GPP2 C.S0014-B, version 1.0, section 4.9.4.9. However, other approaches may be used.

The electronic device 102 may determine 408 whether the synthesis filter gain 116 reaches a synthesis filter gain threshold (e.g., ≥18 dB). This may be accomplished as described above in connection with FIG. 3, for example. If the synthesis filter gain 116 does not reach (e.g., is less than)

the synthesis filter gain threshold (e.g., 18 dB), then the electronic device 102 may return to determine 402 a linear predictive coding synthesis filter gain (for a subsequent frame or subframe, for example).

If the synthesis filter gain 116 reaches (e.g., is greater than or equal to) the synthesis filter gain threshold (e.g., 18 dB), then the electronic device 102 may determine 410 whether the fixed codebook gain 118 reaches a fixed codebook gain threshold (e.g., ≥2322). This may be accomplished as described above in connection with FIG. 3, for example. If the fixed codebook gain 118 does not reach (e.g., is less than) the fixed codebook gain threshold (e.g., 2322), then the electronic device 102 may return to determine 402 a linear predictive coding synthesis filter gain (for a subsequent frame or subframe, for example).

If the fixed codebook gain 118 reaches (e.g., is greater than or equal to) the fixed codebook gain threshold (e.g., 2322), then the electronic device 102 may determine 412 whether the adaptive codebook gain 120 reaches an adaptive codebook gain threshold (e.g., ≥4 1.0). If the adaptive codebook gain 120 does not reach (e.g., is less than) the adaptive codebook gain threshold (e.g., ≥1.0), then the electronic device 102 may return to determine 402 a linear predictive coding synthesis filter gain (for a subsequent frame or subframe, for example).

If the adaptive codebook gain 120 reaches (e.g., is greater than or equal to) the adaptive codebook gain threshold (e.g., ≥1.0), then the electronic device 102 may determine 414 a scaling factor. For example, this may be accomplished as described in connection with FIG. 2.

The electronic device 102 may scale 416 a signal 112 based on the scaling factor 124. For example, this may be accomplished as described above in connection with FIG. 2. The electronic device 102 may return to determine 402 a synthesis filter gain 116. This may be done for a subsequent frame or subframe.

Figure 5:
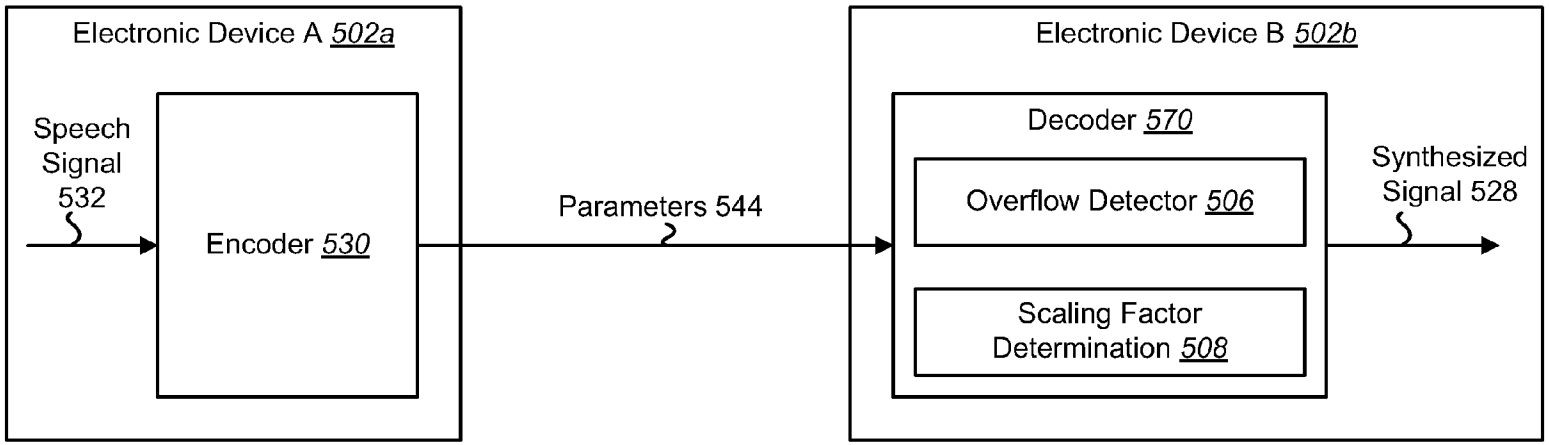
FIG. 5 is a block diagram illustrating one configuration of electronic devices in which systems and methods for detecting overflow may be implemented.

FIG. 5 is a block diagram illustrating one configuration of electronic devices 502*a-b* in which systems and methods for detecting overflow may be implemented. Electronic device A 502*a* includes an encoder 530. The encoder 530 encodes a speech signal 532. For example, the encoder 530 represents the speech signal 532 as parameters 544. The parameters 544 may be transmitted to electronic device B 502*b*. Additionally or alternatively, the parameters 544 may be stored on electronic device A 502*a* and/or decoded on electronic device A 502*a*. Examples of the parameters 544 include one or more of a pitch lag, a codebook index, a fixed codebook gain and an adaptive codebook gain, etc.

Electronic device B 502*b* may include a decoder 570. The decoder 570 may generate a synthesized signal 528 (e.g., synthesized speech) based on the parameters 544. The decoder 570 may include an overflow detector 506 and a scaling factor determination block/module 508. The overflow detector 506 may be implemented in accordance with the overflow detector 106 described above in connection with FIG. 1. The scaling factor determination block/module 508 may be implemented in accordance with the scaling factor determination block/module 108 described above in connection with FIG. 1. The systems and methods disclosed herein may provide protection against overflow when there is a mismatch between the encoder 530 and the decoder 570, for example when there are frame erasures. It should be noted that the systems and methods disclosed herein may be implemented in a decoder 570, in an encoder 530 or both.

Figure 6:
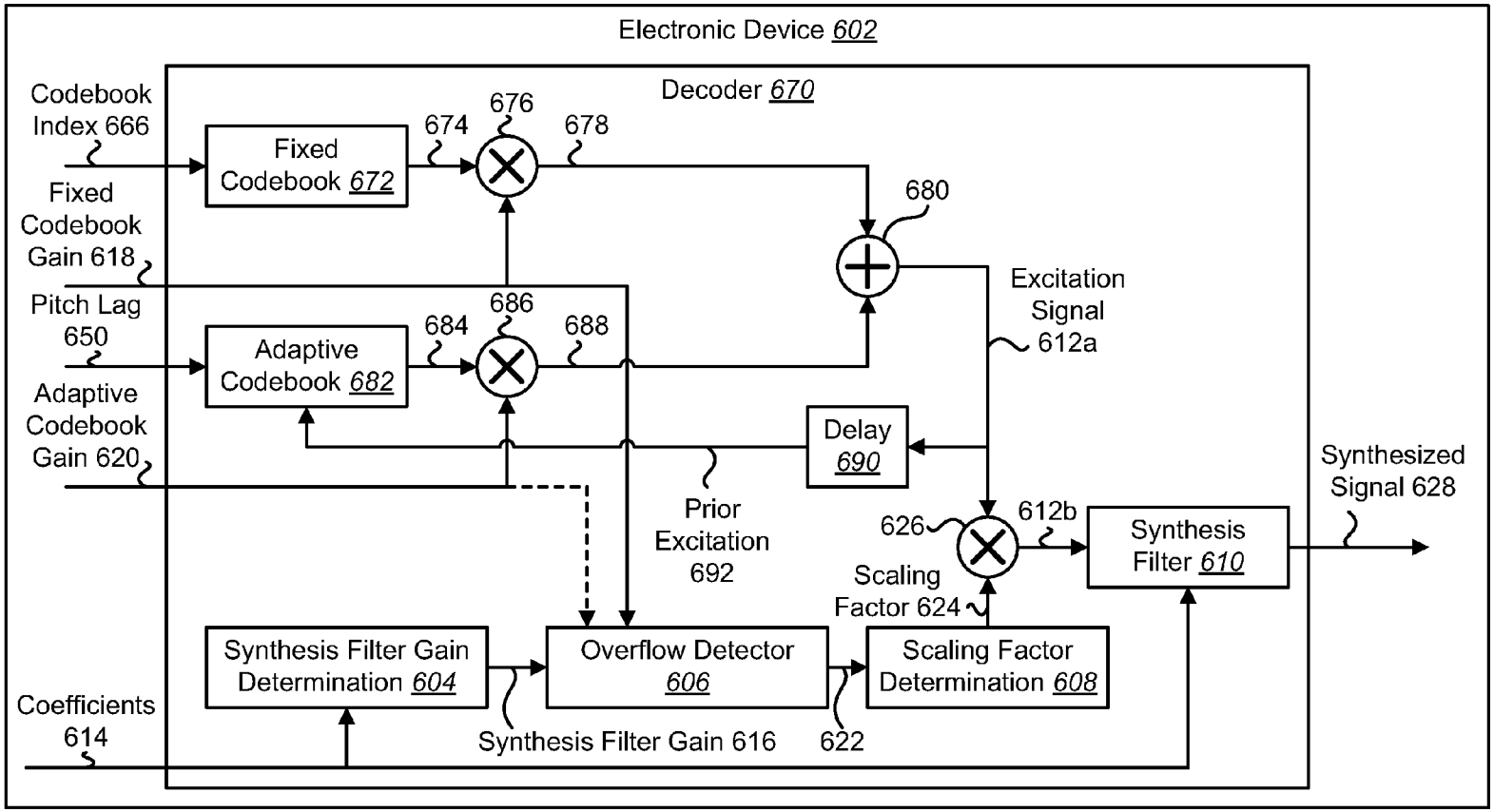
FIG. 6 is a block diagram illustrating one configuration of an electronic device in which systems and methods for detecting overflow may be implemented.

FIG. 6 is a block diagram illustrating one configuration of an electronic device 602 in which systems and methods for detecting overflow may be implemented. The electronic device 602 includes a decoder 670. The decoder 670 provides a synthesized signal 628 (e.g., decoded speech signal). For example, the decoder 670 provides the synthesized signal 628 based on a pitch lag 650, codebook index 666, fixed codebook gain 618, adaptive codebook gain 620 and (linear predictive coding) coefficients 614, which may be received from an encoder.

The decoder 670 may include a (linear predictive coding) synthesis filter gain determination block/module 604, an overflow detector 606, a scaling factor determination block/module 608, a first multiplier 626 (e.g., amplifier, attenuator, etc.), a (linear predictive coding) synthesis filter 610, a summer 680, a second multiplier 676 (e.g., amplifier, attenuator, etc.), a third multiplier 686 (e.g., amplifier, attenuator, etc.), an adaptive codebook 682, a fixed codebook 672 and a delay block/module 690. As used herein, the term "block/module" indicates that an element may be implemented in hardware, software or a combination of both. For example, the scaling factor determination block/module 608 may be implemented in hardware, software or a combination of both. Moreover, it should be noted that one or more of the elements depicted within the electronic device 602 may be implemented as circuitry.

The decoder 670 obtains a pitch lag 650, codebook index 666, fixed codebook gain 618, adaptive codebook gain 620 and coefficients 614. For instance, a receiver included in the electronic device 602 may receive the pitch lag 650, codebook index 666, fixed codebook gain 618, adaptive codebook gain 620 and coefficients 614 from another device and provide them to the decoder 670. Additionally or alternatively, the decoder 670 may obtain them from memory. Alternatively, the decoder 670 may obtain them from an encoder included in the electronic device 602.

The coefficients 614 may be provided to the synthesis filter gain determination block/module 604 and to the synthesis filter 610. In some configurations, the coefficients 614 may be converted from line spectral pairs (LSP) or line spectral frequencies (LSF).

The adaptive codebook 682 may produce an adaptive codebook excitation 684 based on the pitch lag 650 and a prior excitation 692. For example, the adaptive codebook 682 may produce the adaptive codebook excitation 684 based on the pitch lag 650. Furthermore, the adaptive codebook 682 may be updated based on the prior excitation 692. The adaptive codebook excitation 684 may be provided to the third multiplier 686.

The adaptive codebook gain 620 may be provided to the third multiplier 686. In some configurations, the adaptive codebook gain 620 may be optionally provided to the overflow detector 606. In some configurations, the adaptive codebook gain 620 may be quantized.

The codebook index 666 may be provided to the fixed codebook 672. The fixed codebook 672 may produce a fixed codebook contribution 674 based on the codebook index. For example, a particular codebook entry may be selected based on the codebook index 666. The selected codebook entry may be indicated by the codebook index 666 and may correspond to the fixed codebook contribution 674. The fixed codebook contribution 674 may be provided to the second multiplier 676.

The fixed codebook gain 618 may be provided to the second multiplier 676 and to the overflow detector 606. In some configurations, the fixed codebook gain 618 may be quantized. The second multiplier 676 may multiply the fixed codebook contribution 674 by the fixed codebook gain 618 to yield a scaled fixed codebook contribution 678, which may be provided to the summer 680. The third multiplier 686 may multiply the adaptive codebook excitation 684 by the adaptive codebook gain 620 to yield a scaled adaptive codebook excitation 688, which may be provided to the summer 680. The summer 680 may sum the scaled fixed codebook contribution 678 and the scaled adaptive codebook excitation 688 to produce an excitation signal 612*a*. The excitation signal 612*a* may be provided to the delay block/module 690 and to the first multiplier 626.

The delay block/module 690 may provide a prior excitation 692 to the adaptive codebook 682. For example, the delay block/module 690 may delay the excitation signal 612*a* in order to provide a prior excitation 692 from a prior frame or subframe to the adaptive codebook 682. The adaptive codebook 682 may be updated based on the prior excitation 692.

The synthesis filter gain determination block/module 604 may determine a (linear predictive coding) synthesis filter gain 616. For example, the synthesis filter gain determination block/module 604 may determine the synthesis filter gain 616 based on (linear predictive coding) coefficients 614. The synthesis filter gain 616 and a fixed codebook gain 618 may be provided to the overflow detector 606. In some configurations, an adaptive codebook gain 620 may also be provided to the overflow detector 606.

The overflow detector 606 may determine whether or not overflow is detected. For example, the overflow detector 606 may determine whether or not overflow (and/or saturation, for example) would occur at the output of the synthesis filter 610 if the excitation signal 612*a* is not scaled down. In one configuration, this determination may be made based on the synthesis filter gain 616 and the fixed codebook gain 618. For example, the overflow detector 606 may determine whether the synthesis filter gain 616 reaches a synthesis filter gain threshold (e.g., ≥18 dB) and may determine whether the fixed codebook gain 618 reaches a fixed codebook threshold (e.g., >2322).

For instance, the synthesis filter gain 616 may require a number of bits for representation and the fixed codebook gain 618 may require another number of bits for representation. If the total number of bits required to represent the synthesis filter gain 616 and the fixed codebook gain 618 exceed (e.g., meet or exceed in some configurations) the number of bits available for a maximum dynamic range at the output of the synthesis filter 610 (or another threshold amount), then overflow may be detected.

In one example, 18 dB of synthesis filter gain 616 corresponds to three bits (e.g., one bit corresponds to 6 dB) and 12 bits are required to represent a value of 2322 for the fixed codebook gain 618. This may result in the output requiring 3+12=15 bits of dynamic range, which is the maximum dynamic range for a signed 16-bit number.

In some configurations, overflow detection may additionally be based on the adaptive codebook gain 620. For example, if the synthesis filter gain 616 reaches a synthesis filter gain threshold, if the corresponding fixed codebook gain 618 reaches a fixed codebook gain threshold and the corresponding adaptive codebook gain 620 reaches an adaptive codebook gain threshold (e.g., ≥1.0), then the overflow detector 606 may detect overflow. However, it should be noted that overflow detection may not be based on the adaptive codebook gain 620 as described above.

In the case that overflow is detected, the overflow detector 606 may provide an indication 622 to the scaling factor determination block/module 608. In this case, the scaling factor determination block/module 608 may determine a scaling factor 624. For example, the scaling factor 624 may be determined such that the output of the synthesis filter 610 (e.g., the synthesized signal 628) does not exceed the maximum allowed dynamic range. Additionally or alternatively, the scaling factor 624 may be determined such that the output of the linear predictive synthesis filter allows an amount of headroom (e.g., 1 bit). The scaling factor 624 may be provided to the first multiplier 626.

As illustrated in FIG. 6, the excitation signal 612*a* may be scaled based on the scaling factor 624. For example, the excitation signal 612*a* may be scaled by the first multiplier 626 in accordance with the scaling factor 624 before being input into the synthesis filter 610. For instance, if overflow is detected, then the excitation signal 612*a* may be scaled down. If no overflow is detected, then the excitation signal 612*a* may not be scaled (by bypassing the first multiplier 626, for example) or may be scaled by a factor of 1. The resulting signal 612*b* (e.g., a product of the excitation signal 612*a* and the scaling factor 624 when overflow is detected or a non-scaled (or scaled by 1) signal when overflow is not detected) may be provided to the synthesis filter 610. It should be noted that the excitation signal 612*a* that is carried forward to a subsequent frame (by the delay block/module 690, for example) may not be scaled (since this could impact tonal quality, for example).

The synthesis filter 610 may produce a synthesized signal 628 based on the coefficients 614 and the excitation signal 612. For example, the coefficients 614 may specify the response of the synthesis filter 610. The synthesis filter 610 may filter the (scaled or unscaled) excitation signal 612*b* to produce the synthesized signal 628. The synthesized signal 628 may be provided by the decoder 670. For example, the synthesized signal 628 may be provided to one or more speakers, to memory, to one or more filters (for post-processing, for example), etc.

Figure 7:
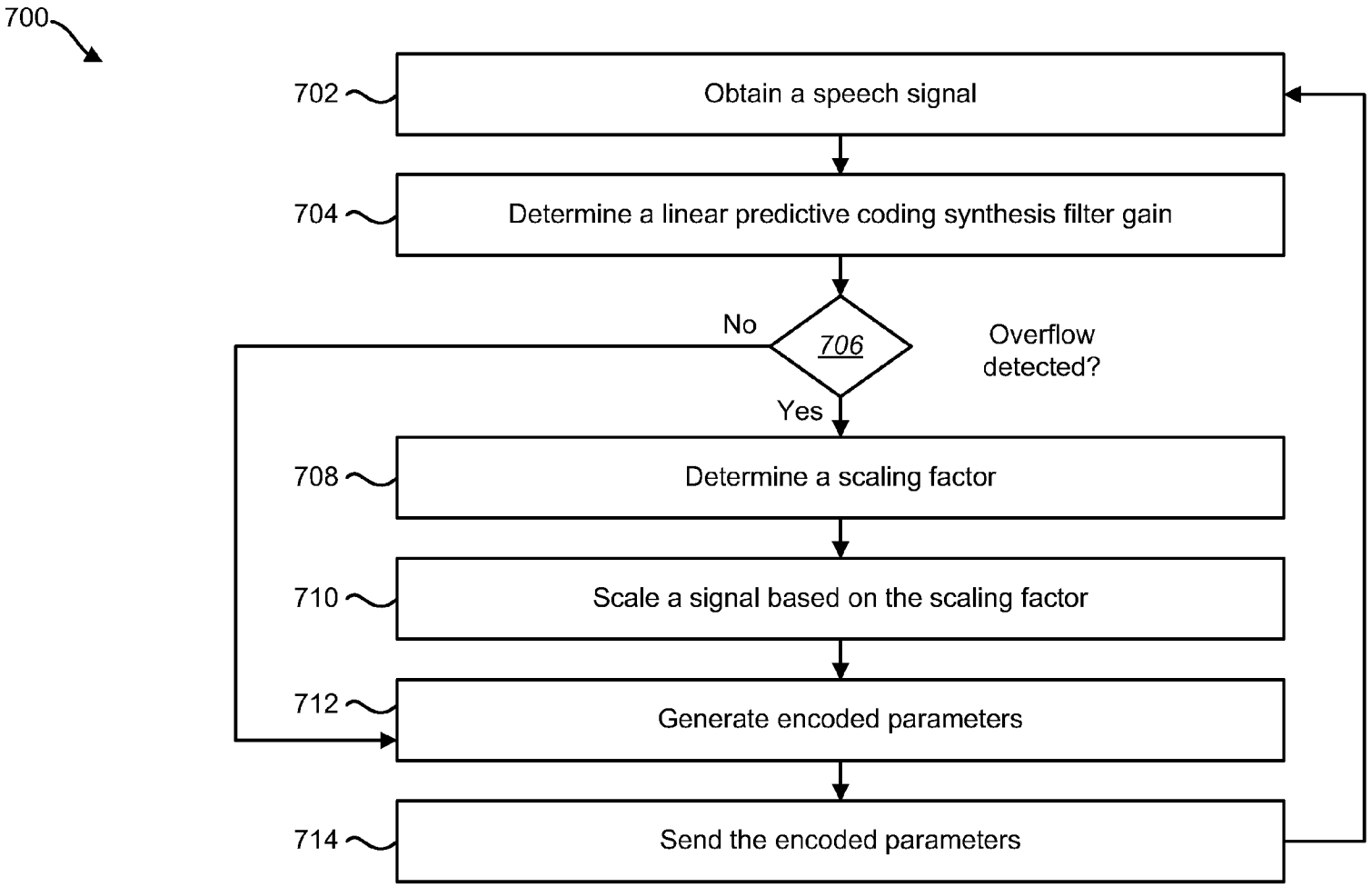
FIG. 7 is a flow diagram illustrating another more specific configuration of a method for detecting overflow.

FIG. 7 is a flow diagram illustrating another more specific configuration of a method 700 for detecting overflow. An electronic device 102 may obtain 702 a speech signal. For example, the electronic device 102 may capture a speech signal with one or more microphones. Alternatively, the electronic device 102 may receive the speech signal from another device (e.g., a Bluetooth headset).

An electronic device 102 may determine 704 a (linear predictive coding) synthesis filter gain 116. This may be done as described above in connection with FIG. 2 and/or FIG. 5, for example.

The electronic device 102 may determine 706 whether overflow is detected. For example, the electronic device 102 may determine 706 whether overflow is detected as described in connection with FIG. 2, FIG. 3, FIG. 4 and/or FIG. 5. In some configurations, this determination 706 may be based on the synthesis filter gain 116 and the fixed codebook gain 118. In other configurations, this determination 706 may be additionally based on an adaptive codebook gain 120.

If overflow is not detected, the electronic device 102 may generate 712 encoded parameters. For example, if overflow is not detected, then the electronic device 102 may not scale a residual signal (or may scale the residual signal by a factor of 1). In this case, the electronic device 102 may generate encoded parameters including a pitch lag, codebook index, fixed codebook gain, adaptive codebook gain and/or (linear predictive coding) coefficients. Accordingly, one or more of the encoded parameters (for a particular frame or subframe, for example) may not be based on a scaled down residual signal if overflow is not detected.

If overflow is detected, the electronic device 102 may determine 708 a scaling factor 124. For example, the scaling factor 124 may be determined 708 such that the output of the synthesis filter 110 (e.g., the synthesized speech) does not exceed a maximum allowed dynamic range. Additionally or alternatively, the scaling factor 124 may be determined such that the output of the linear predictive synthesis filter allows an amount of headroom (e.g., 1 bit).

The electronic device 102 may scale 710 a signal 112 based on the scaling factor 124. For example, a residual signal or excitation signal 112 may be multiplied by the scaling factor 124 before being input into the synthesis filter 110. For instance, if overflow is detected, then the signal 112 may be scaled down. It should be noted that a signal 112*a* (e.g., a residual signal or excitation signal) that is carried forward to a subsequent frame may not be scaled.

In the case that overflow is detected, the electronic device 102 may generate 712 encoded parameters. In this case, the electronic device 102 may generate encoded parameters including a pitch lag, codebook index, fixed codebook gain, adaptive codebook gain and/or (linear predictive coding) coefficients. Accordingly, one or more of the encoded parameters (for a particular frame or subframe, for example) may be based on a scaled down residual signal if overflow is detected.

Whether or not overflow is detected, the electronic device 102 may send 714 the encoded parameters. For example, the electronic device 102 may send 714 encoded parameters including a pitch lag, codebook index, fixed codebook gain, adaptive codebook gain and/or (linear predictive coding) coefficients. For instance, the electronic device 102 may provide one or more of the encoded parameters to a transmitter, which may perform one or more transmission operations (e.g., modulation, channel coding, upconversion, etc.) on the encoded parameters. The electronic device 102 may then send the encoded parameters on a wireless and/or wired medium. The electronic device 102 may return to obtain 702 a speech signal. This may be done for a subsequent frame or subframe.

Figure 8:
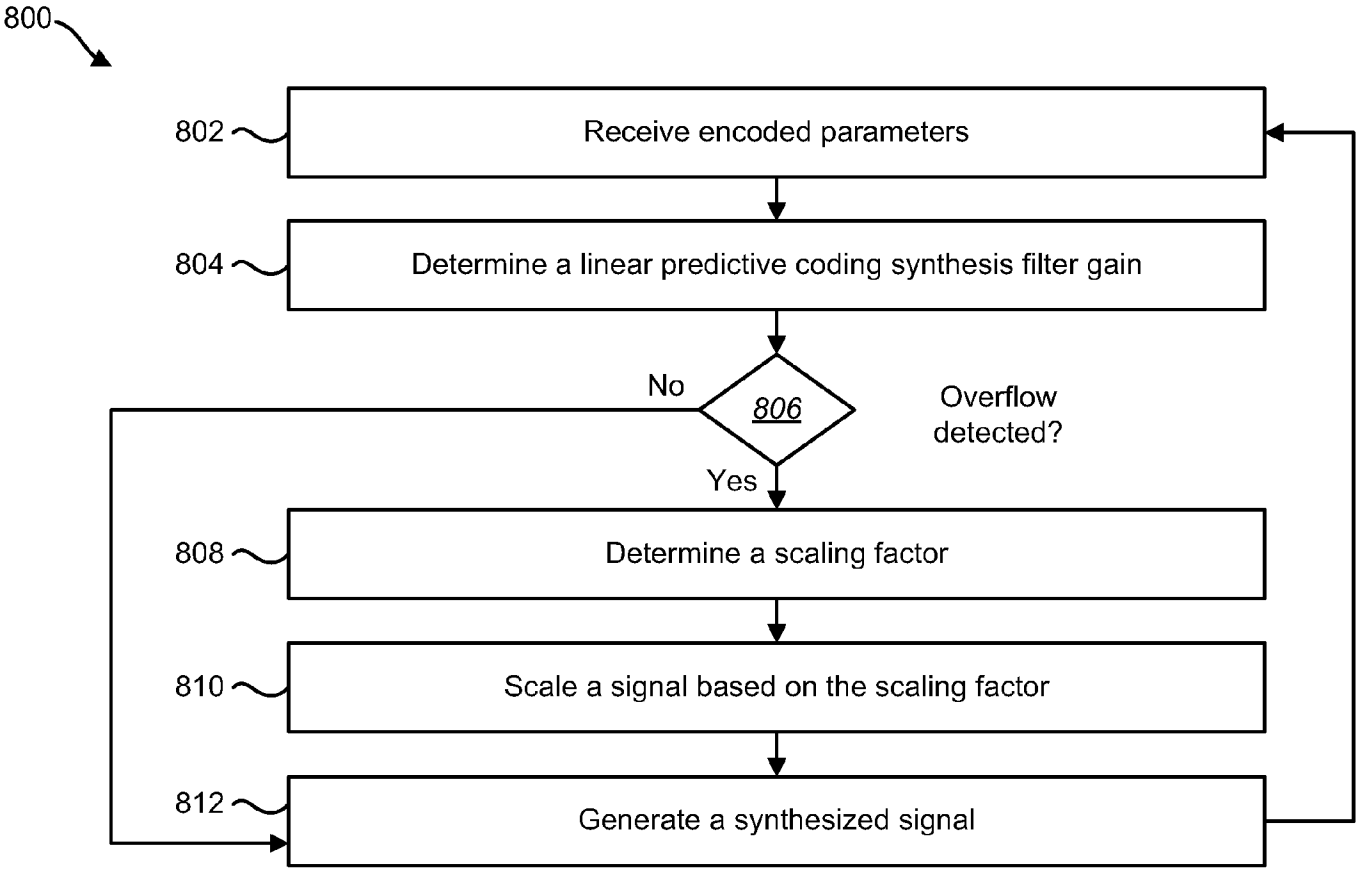
FIG. 8 is a flow diagram illustrating another more specific configuration of a method for detecting overflow.

FIG. 8 is a flow diagram illustrating another more specific configuration of a method 800 for detecting overflow. For example, this method 800 may be performed by a decoding device. An electronic device 102 may receive 802 encoded parameters. The encoded parameters may include a pitch lag, codebook index, fixed codebook gain, adaptive codebook gain and/or (linear predictive coding) coefficients. For instance, the electronic device 102 may obtain one or more of the encoded parameters from a receiver, which may perform one or more reception operations (e.g., downconversion, demodulation, channel decoding, etc.) on a signal received from a wireless and/or wired medium in order to obtain the encoded parameters.

An electronic device 102 may determine 804 a (linear predictive coding) synthesis filter gain 116. This may be done as described above in connection with FIG. 2 and/or FIG. 6, for example.

The electronic device 102 may determine 806 whether overflow is detected. For example, the electronic device 102 may determine 806 whether overflow is detected as described in connection with FIG. 2, FIG. 3, FIG. 4 and/or FIG. 6. In some configurations, this determination 806 may be based on the synthesis filter gain 116 and the fixed codebook gain 118. In other configurations, this determination 806 may be additionally based on an adaptive codebook gain 120.

If overflow is not detected, the electronic device 102 may generate 812 a synthesized signal 128. For example, if overflow is not detected, then the electronic device 102 may not scale a signal 112 (e.g., a residual signal or an excitation signal) (or may scale the signal 112*a* by a factor of 1). Accordingly, the synthesized signal 128 (for a particular frame or subframe, for example) may not be based on a scaled down signal if overflow is not detected.

If overflow is detected, the electronic device 102 may determine 808 a scaling factor 124. For example, the scaling factor 124 may be determined 808 such that the output of the synthesis filter 110 (e.g., the synthesized signal 128) does not exceed a maximum allowed dynamic range. Additionally or alternatively, the scaling factor 124 may be determined such that the output of the linear predictive synthesis filter allows an amount of headroom (e.g., 1 bit).

The electronic device 102 may scale 810 a signal 112 based on the scaling factor 124. For example, a signal 112*a* (e.g., residual signal or excitation signal) may be multiplied by the scaling factor 124 before being input into the synthesis filter 110. For instance, if overflow is detected, then the signal 112 may be scaled down. It should be noted that a residual signal or excitation signal that is carried forward to a subsequent frame may not be scaled.

In the case that overflow is detected, the electronic device 102 may generate 812 a synthesized signal 128. More specifically, the electronic device 102 may generate the synthesized signal 128 (for a particular frame or subframe, for example) based on a scaled down residual signal if overflow is detected. The electronic device 102 may return to receive encoded parameters. This may be done for a subsequent frame or subframe.

Figure 9:
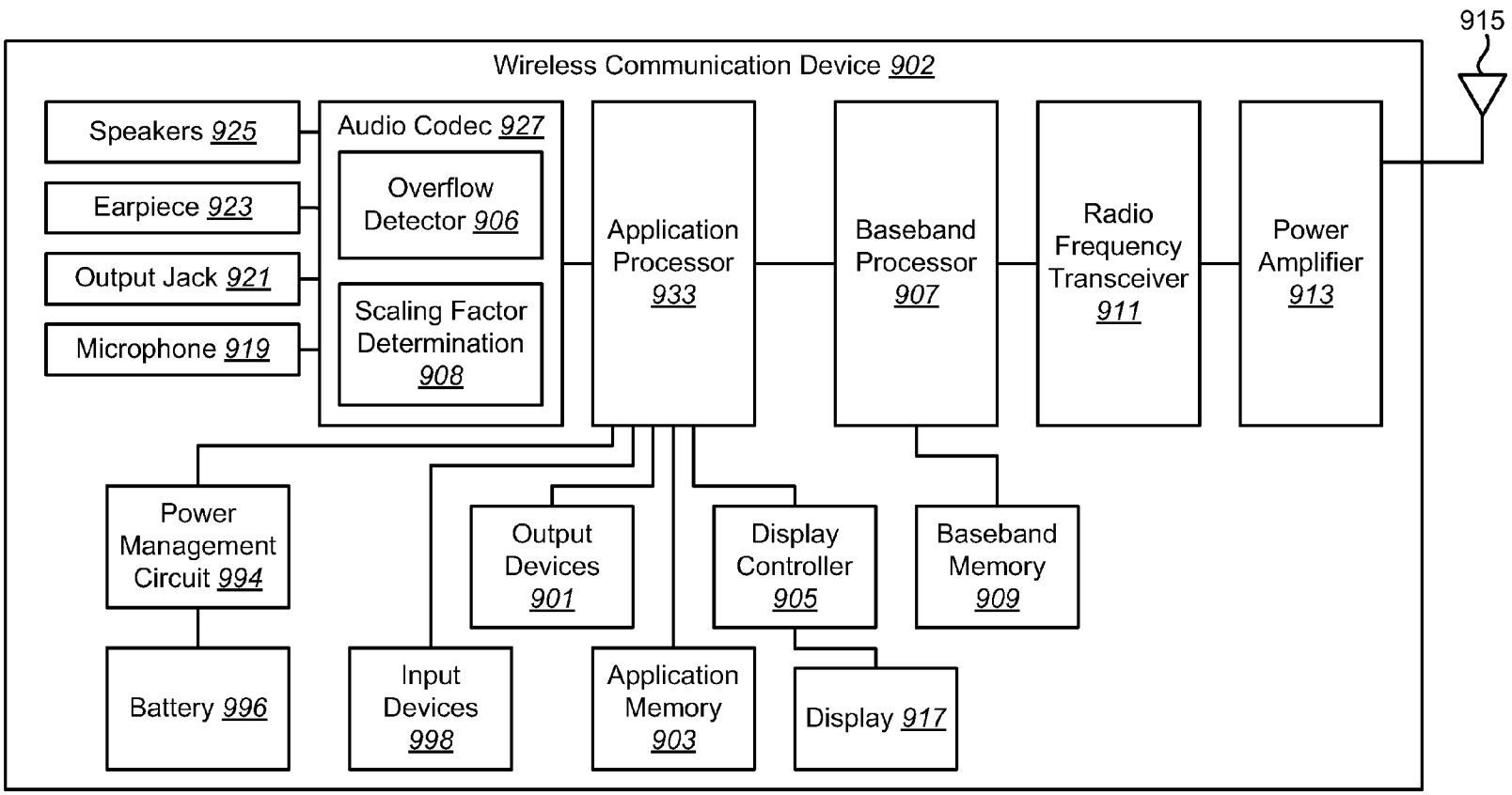
FIG. 9 is a block diagram illustrating one configuration of a wireless communication device in which systems and methods for detecting overflow may be implemented.

FIG. 9 is a block diagram illustrating one configuration of a wireless communication device 902 in which systems and methods for detecting overflow may be implemented. The wireless communication device 902 illustrated in FIG. 9 may be an example of one or more of the electronic devices 102, 502, 602, 1002 described herein. The wireless communication device 902 may include an application processor 933. The application processor 933 generally processes instructions (e.g., runs programs) to perform functions on the wireless communication device 902. The application processor 933 may be coupled to an audio coder/decoder (codec) 927.

The audio codec 927 may be an electronic device (e.g., integrated circuit) used for coding and/or decoding audio signals. The audio codec 927 may be coupled to one or more speakers 925, an earpiece 923, an output jack 921 and/or one or more microphones 919. The speakers 925 may include one or more electro-acoustic transducers that convert electrical or electronic signals into acoustic signals. For example, the speakers 925 may be used to play music or output a speakerphone conversation, etc. The earpiece 923 may be another speaker or electro-acoustic transducer that can be used to output acoustic signals (e.g., speech signals) to a user. For example, the earpiece 923 may be used such that only a user may reliably hear the acoustic signal. The output jack 921 may be used for coupling other devices to the wireless communication device 902 for outputting audio, such as headphones. The speakers 925, earpiece 923 and/or output jack 921 may generally be used for outputting an audio signal from the audio codec 927. The one or more microphones 919 may be acousto-electric transducer that converts an acoustic signal (such as a user's voice) into electrical or electronic signals that are provided to the audio codec 927.

The audio codec 927 may include an overflow detector 906. The overflow detector 906 may be configured similarly to one or more of the overflow detectors 106, 506, 606 described above. Additionally or alternatively, the overflow detector 906 may detect overflow in accordance with one or more of the methods 200, 300, 400, 700, 800 described above. The audio codec 927 may additionally include a scaling factor determination block/module 908. The scaling factor determination block/module 908 may be configured similarly to one or more of the scaling factor determination blocks/modules 108, 508, 608 described above. Additionally or alternatively, the scaling factor determination block/module 908 may determine a scaling factor in accordance with one or more of the methods 200, 300, 400, 700, 800 described above. In some configurations, one or more of the methods 200, 300, 400, 700, 800 described above may be performed by the audio codec 927. One or more of the functions performed by the overflow detector 906 and/or the scale factor determination block/module 908 may additionally or alternatively be performed by the application processor 933.

The application processor 933 may also be coupled to a power management circuit 994. One example of a power management circuit 994 is a power management integrated circuit (PMIC), which may be used to manage the electrical power consumption of the wireless communication device 902. The power management circuit 994 may be coupled to a battery 996. The battery 996 may generally provide electrical power to the wireless communication device 902.

The application processor 933 may be coupled to one or more input devices 998 for receiving input. Examples of input devices 998 include infrared sensors, image sensors, accelerometers, touch sensors, keypads, etc. The input devices 998 may allow user interaction with the wireless communication device 902. The application processor 933 may also be coupled to one or more output devices 901. Examples of output devices 901 include printers, projectors, screens, haptic devices, etc. The output devices 901 may allow the wireless communication device 902 to produce output that may be experienced by a user.

The application processor 933 may be coupled to application memory 903. The application memory 903 may be any electronic device that is capable of storing electronic information. Examples of application memory 903 include double data rate synchronous dynamic random access memory (DDRAM), synchronous dynamic random access memory (SDRAM), flash memory, etc. The application memory 903 may provide storage for the application processor 933. For instance, the application memory 903 may store data and/or instructions for the functioning of programs that are run on the application processor 933.

The application processor 933 may be coupled to a display controller 905, which in turn may be coupled to a display 917. The display controller 905 may be a hardware block that is used to generate images on the display 917. For example, the display controller 905 may translate instructions and/or data from the application processor 933 into images that can be presented on the display 917. Examples of the display 917 include liquid crystal display (LCD) panels, light emitting diode (LED) panels, cathode ray tube (CRT) displays, plasma displays, etc.

The application processor 933 may be coupled to a baseband processor 907. The baseband processor 907 generally processes communication signals. For example, the baseband processor 907 may demodulate and/or decode received signals. Additionally or alternatively, the baseband processor 907 may encode and/or modulate signals in preparation for transmission.

The baseband processor 907 may be coupled to baseband memory 909. The baseband memory 909 may be any electronic device capable of storing electronic information, such as SDRAM, DDRAM, flash memory, etc. The baseband processor 907 may read information (e.g., instructions and/or data) from and/or write information to the baseband memory 909. Additionally or alternatively, the baseband processor 907 may use instructions and/or data stored in the baseband memory 909 to perform communication operations.

The baseband processor 907 may be coupled to a radio frequency (RF) transceiver 911. The RF transceiver 911 may be coupled to a power amplifier 913 and one or more antennas 915. The RF transceiver 911 may transmit and/or receive radio frequency signals. For example, the RF transceiver 911 may transmit an RF signal using a power amplifier 913 and one or more antennas 915. The RF transceiver 911 may also receive RF signals using the one or more antennas 915.

Figure 10:
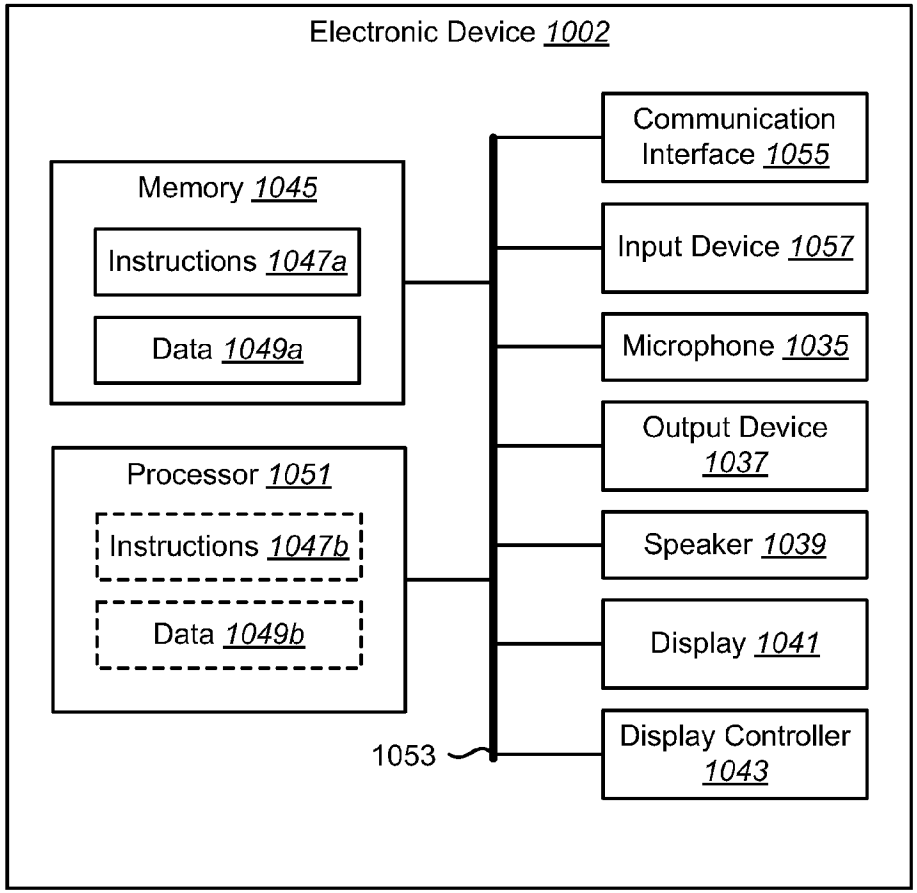
FIG. 10 illustrates various components that may be utilized in an electronic device.

FIG. 10 illustrates various components that may be utilized in an electronic device 1002. The illustrated components may be located within the same physical structure or in separate housings or structures. The electronic device 1002 described in connection with FIG. 10 may be implemented in accordance with one or more of the electronic devices 102, 502, 602 and the wireless communication device 902 described herein. The electronic device 1002 includes a processor 1051. The processor 1051 may be a general purpose single- or multi-chip microprocessor (e.g., an ARM), a special purpose microprocessor (e.g., a digital signal processor (DSP)), a microcontroller, a programmable gate array, etc. The processor 1051 may be referred to as a central processing unit (CPU). Although just a single processor 1051 is shown in the electronic device 1002 of FIG. 10, in an alternative configuration, a combination of processors (e.g., an ARM and DSP) could be used.

The electronic device 1002 also includes memory 1045 in electronic communication with the processor 1051. That is, the processor 1051 can read information from and/or write information to the memory 1045. The memory 1045 may be any electronic component capable of storing electronic information. The memory 1045 may be random access memory (RAM), read-only memory (ROM), magnetic disk storage media, optical storage media, flash memory devices in RAM, on-board memory included with the processor, programmable read-only memory (PROM), erasable programmable read-only memory (EPROM), electrically erasable PROM (EEPROM), registers, and so forth, including combinations thereof.

Data 1049*a* and instructions 1047*a* may be stored in the memory 1045. The instructions 1047*a* may include one or more programs, routines, sub-routines, functions, procedures, etc. The instructions 1047*a* may include a single computer-readable statement or many computer-readable statements. The instructions 1047*a* may be executable by the processor 1051 to implement one or more of the methods 200, 300, 400, 700, 800 described above. Executing the instructions 1047*a* may involve the use of the data 1049*a* that is stored in the memory 1045. FIG. 10 shows some instructions 1047*b* and data 1049*b* being loaded into the processor 1051 (which may come from instructions 1047*a* and data 1049*a*).

The electronic device 1002 may also include one or more communication interfaces 1055 for communicating with other electronic devices. The communication interfaces 1055 may be based on wired communication technology, wireless communication technology, or both. Examples of different types of communication interfaces 1055 include a serial port, a parallel port, a Universal Serial Bus (USB), an Ethernet adapter, an IEEE 1394 bus interface, a small computer system interface (SCSI) bus interface, an infrared (IR) communication port, a Bluetooth wireless communication adapter, and so forth.

The electronic device 1002 may also include one or more input devices 1057 and one or more output devices 1037. Examples of different kinds of input devices 1057 include a keyboard, mouse, microphone, remote control device, button, joystick, trackball, touchpad, lightpen, etc. For instance, the electronic device 1002 may include one or more microphones 1035 for capturing acoustic signals. In one configuration, a microphone 1035 may be a transducer that converts acoustic signals (e.g., voice, speech) into electrical or electronic signals. Examples of different kinds of output devices 1037 include a speaker, printer, etc. For instance, the electronic device 1002 may include one or more speakers 1039. In one configuration, a speaker 1039 may be a transducer that converts electrical or electronic signals into acoustic signals. One specific type of output device which may be typically included in an electronic device 1002 is a display device 1041. Display devices 1041 used with configurations disclosed herein may utilize any suitable image projection technology, such as a cathode ray tube (CRT), liquid crystal display (LCD), light-emitting diode (LED), gas plasma, electroluminescence, or the like. A display controller 1043 may also be provided, for converting data stored in the memory 1045 into text, graphics, and/or moving images (as appropriate) shown on the display device 1041.

The various components of the electronic device 1002 may be coupled together by one or more buses, which may include a power bus, a control signal bus, a status signal bus, a data bus, etc. For simplicity, the various buses are illustrated in FIG. 10 as a bus system 1053. It should be noted that FIG. 10 illustrates only one possible configuration of an electronic device 1002. Various other architectures and components may be utilized.

In the above description, reference numbers have sometimes been used in connection with various terms. Where a term is used in connection with a reference number, this may be meant to refer to a specific element that is shown in one or more of the Figures. Where a term is used without a reference number, this may be meant to refer generally to the term without limitation to any particular Figure.

The term "determining" encompasses a wide variety of actions and, therefore, "determining" can include calculating, computing, processing, deriving, investigating, looking up (e.g., looking up in a table, a database or another data structure), ascertaining and the like. Also, "determining" can include receiving (e.g., receiving information), accessing (e.g., accessing data in a memory) and the like. Also, "determining" can include resolving, selecting, choosing, establishing and the like.

The phrase "based on" does not mean "based only on," unless expressly specified otherwise. In other words, the phrase "based on" describes both "based only on" and "based at least on."

The functions described herein may be stored as one or more instructions on a processor-readable or computer-readable medium. The term "computer-readable medium" refers to any available medium that can be accessed by a computer or processor. By way of example, and not limitation, such a medium may comprise RAM, ROM, EEPROM, flash memory, CD-ROM or other optical disk storage, magnetic disk storage or other magnetic storage devices, or any other medium that can be used to store desired program code in the form of instructions or data structures and that can be accessed by a computer. Disk and disc, as used herein, includes compact disc (CD), laser disc, optical disc, digital versatile disc (DVD), floppy disk and Blu-ray® disc where disks usually reproduce data magnetically, while discs reproduce data optically with lasers. It should be noted that a computer-readable medium may be tangible and non-transitory. The term "computer-program product" refers to a computing device or processor in combination with code or instructions (e.g., a "program") that may be executed, processed or computed by the computing device or processor. As used herein, the term "code" may refer to software, instructions, code or data that is/are executable by a computing device or processor.

Software or instructions may also be transmitted over a transmission medium. For example, if the software is transmitted from a website, server, or other remote source using a coaxial cable, fiber optic cable, twisted pair, digital subscriber line (DSL), or wireless technologies such as infrared, radio, and microwave, then the coaxial cable, fiber optic cable, twisted pair, DSL, or wireless technologies such as infrared, radio, and microwave are included in the definition of transmission medium.

The methods disclosed herein comprise one or more steps or actions for achieving the described method. The method steps and/or actions may be interchanged with one another without departing from the scope of the claims. In other words, unless a specific order of steps or actions is required for proper operation of the method that is being described, the order and/or use of specific steps and/or actions may be modified without departing from the scope of the claims.

It is to be understood that the claims are not limited to the precise configuration and components illustrated above. Various modifications, changes and variations may be made in the arrangement, operation and details of the systems, methods, and apparatus described herein without departing from the scope of the claims.

What is claimed is:

1. A method for detecting overflow on an electronic device, comprising:

determining, by an audio codec, a linear predictive coding synthesis filter gain;

determining, by the audio codec, whether overflow is detected based on the linear predictive coding synthesis filter gain and comparing a fixed codebook gain to a fixed codebook gain threshold; and determining, by the audio codec, a scaling factor in a case that overflow is detected.

2. The method of claim 1, wherein the scaling factor is determined such that an output of a linear predictive coding synthesis filter does not exceed a maximum dynamic range.

3. The method of claim 1, further comprising scaling a signal based on the scaling factor if overflow is detected.

4. The method of claim 1, wherein overflow is detected in a case that the linear predictive coding synthesis filter gain is greater than or equal to a synthesis filter gain threshold and the fixed codebook gain is greater than or equal to the fixed codebook gain threshold.

5. The method of claim 1, wherein determining the linear predictive coding synthesis filter gain comprises:

determining an impulse response corresponding to a linear predictive coding synthesis filter; and determining an energy of the impulse response.

6. The method of claim 1, wherein the method is performed by at least one of a group consisting of a decoder and an encoder.

7. The method of claim 1, wherein the electronic device is a wireless communication device.

8. The method of claim 1, wherein determining whether overflow is detected is further based on an adaptive codebook gain.

9. The method of claim 1, wherein overflow is detected in a case that the linear predictive coding synthesis filter gain is greater than or equal to a synthesis filter gain threshold, the fixed codebook gain is greater than or equal to a fixed codebook gain threshold, and an adaptive codebook gain is greater than or equal to an adaptive codebook gain threshold.

10. The method of claim 1, wherein in the case that overflow is detected, the scaling factor is not applied to a signal that is carried forward to a subsequent frame or subframe.

11. The method of claim 1, wherein determining whether overflow is detected comprises determining whether a synthesis filter output would exceed a maximum allotted dynamic range if a synthesis filter input is not scaled down.

12. A decoder for detecting overflow, comprising:

synthesis filter gain determination circuitry configured to determine a linear predictive coding synthesis filter gain;

an overflow detector coupled to the synthesis filter gain determination circuitry, wherein the overflow detector is configured to determine whether overflow is detected based on the linear predictive coding synthesis filter gain and a comparison of a fixed codebook gain to a fixed codebook gain threshold; and scaling factor determination circuitry coupled to the overflow detector, wherein the scaling factor determination circuitry is configured to determine a scaling factor in a case that overflow is detected.

13. The decoder of claim 12, wherein the scaling factor is determined such that an output of a linear predictive coding synthesis filter does not exceed a maximum dynamic range.

14. The decoder of claim 12, further comprising a multiplier coupled to the scaling factor determination circuitry, wherein the multiplier scales a signal based on the scaling factor if overflow is detected.

15. The decoder of claim 12, wherein the overflow detector is configured to detect overflow in a case that the linear predictive coding synthesis filter gain is greater than or equal to a synthesis filter gain threshold and the fixed codebook gain is greater than or equal to the fixed codebook gain threshold.

16. The decoder of claim 12, wherein the decoder is configured to determine the linear predictive coding synthesis filter gain by:

determining an impulse response corresponding to a linear predictive coding synthesis filter; and determining an energy of the impulse response.

17. The decoder of claim 12, wherein the overflow detector is configured to determine whether overflow is detected based on an adaptive codebook gain.

18. The decoder of claim 12, wherein the overflow detector is configured to detect overflow in a case that the linear predictive coding synthesis filter gain is greater than or equal to a synthesis filter gain threshold, the fixed codebook gain is greater than or equal to a fixed codebook gain threshold, and an adaptive codebook gain is greater than or equal to an adaptive codebook gain threshold.

19. The decoder of claim 12, wherein in the case that overflow is detected, the decoder is configured to not apply the scaling factor to a signal that is carried forward to a subsequent frame or subframe.

20. The decoder of claim 12, wherein the overflow detector is configured to determine whether overflow is detected by determining whether a synthesis filter output would exceed a maximum allotted dynamic range if a synthesis filter input is not scaled down.

21. A non-transitory tangible computer-readable medium having instructions thereon, the instructions comprising:

code for causing an audio codec to determine a linear predictive coding synthesis filter gain;

code for causing the audio codec to determine whether overflow is detected based on the linear predictive coding synthesis filter gain and comparing a fixed codebook gain to a fixed codebook gain threshold; and code for causing the audio codec to determine a scaling factor in a case that overflow is detected.

22. The non-transitory tangible computer-readable medium of claim 21, wherein the scaling factor is determined such that an output of a linear predictive coding synthesis filter does not exceed a maximum dynamic range.

23. The non-transitory tangible computer-readable medium of claim 21, further comprising code for causing the audio codec to scale a signal based on the scaling factor if overflow is detected.

24. The non-transitory tangible computer-readable medium of claim 21, wherein overflow is detected in a case that the linear predictive coding synthesis filter gain is greater than or equal to a synthesis filter gain threshold and the fixed codebook gain is greater than or equal to the fixed codebook gain threshold.

25. The non-transitory tangible computer-readable medium of claim 21, wherein detecting overflow is further based on an adaptive codebook gain.

26. A decoder for detecting overflow, comprising:

means for determining a linear predictive coding synthesis filter gain;

means for determining whether overflow is detected based on the linear predictive coding synthesis filter gain and comparing a fixed codebook gain to a fixed codebook gain threshold; and means for determining a scaling factor in a case that overflow is detected.

27. The decoder of claim 26, wherein the scaling factor is determined such that an output of a linear predictive coding synthesis filter does not exceed a maximum dynamic range.

28. The decoder of claim 26, further comprising means for scaling a signal based on the scaling factor if overflow is detected.

29. The decoder of claim 26, wherein overflow is detected in a case that the linear predictive coding synthesis filter gain is greater than or equal to a synthesis filter gain threshold and the fixed codebook gain is greater than or equal to the fixed codebook gain threshold.

30. The decoder of claim 26, wherein detecting overflow is further based on an adaptive codebook gain.

* * * * *